US007594471B2

(12) United States Patent
Koekemoer et al.

(10) Patent No.: US 7,594,471 B2
(45) Date of Patent: Sep. 29, 2009

(54) BLASTING SYSTEM AND METHOD OF CONTROLLING A BLASTING OPERATION

(75) Inventors: Andre Koekemoer, Woodmead (ZA); Craig Charles Schlenter, Woodmead (ZA)

(73) Assignee: DetNet South Africa (PTY) Ltd., Sandton (ZA)

( * ) Notice: Subject to any disclaimer, the term of this patent is extended or adjusted under 35 U.S.C. 154(b) by 328 days.

(21) Appl. No.: 11/028,603

(22) Filed: Jan. 5, 2005

(65) Prior Publication Data

US 2006/0027121 A1 Feb. 9, 2006

(30) Foreign Application Priority Data

Jul. 21, 2004 (ZA) ..... 2004/5795

(51) Int. Cl.
*F42B 3/00* (2006.01)

(52) U.S. Cl. ..... 102/301; 102/215

(58) Field of Classification Search ..... 102/200, 102/206, 301, 302, 303, 312, 215; 166/55.1, 166/66, 250.01, 297, 299
See application file for complete search history.

(56) References Cited

U.S. PATENT DOCUMENTS 4,576,093 A * 3/1986 Snyder ..... 102/200
4,674,047 A * 6/1987 Tyler et al. ..... 89/28.05
4,685,396 A * 8/1987 Birse et al. ..... 102/506
5,090,321 A * 2/1992 Abouav ..... 102/200
5,520,114 A 5/1996 Guimard et al.
6,085,659 A * 7/2000 Beukes et al. ..... 102/206
6,546,873 B1 * 4/2003 Andrejkovics et al. ..... 102/200
6,644,202 B1 * 11/2003 Duniam et al. ..... 102/312
6,945,174 B2 * 9/2005 Aebi et al. ..... 102/301
7,146,912 B2 * 12/2006 Bokvist et al. ..... 102/215
2002/0088620 A1 * 7/2002 Lerche et al. ..... 166/297
2002/0178955 A1 * 12/2002 Gavrilovic et al. ..... 102/200
2003/0101888 A1 * 6/2003 Fisher et al. ..... 102/200
2004/0020394 A1 * 2/2004 Boucher et al. ..... 102/217
2004/0045470 A1 * 3/2004 Aebi et al. ..... 102/301
2005/0217525 A1 * 10/2005 McClure et al. ..... 102/311
2006/0037508 A1 * 2/2006 Rudakevych et al. ..... 102/206

FOREIGN PATENT DOCUMENTS

WO WO 2004/020934 3/2004

* cited by examiner

*Primary Examiner*—Troy Chambers
(74) *Attorney, Agent, or Firm*—Fitch, Even, Tabin & Flannery; Norman N. Kunitz

(57) ABSTRACT

A method and apparatus for controlling a blasting operation using blast control equipment to initiate a plurality of detonators at a blast site. According to the method, the full use of the blast control equipment is inhibited, a validation process on information is conducted, and, if the information is validated, at least partial use of the blast control equipment is enabled. The blasting system includes at least one installation of blast control equipment and a plurality of detonators that are configured to be initiated by the blast control equipment, a control facility, and a transmitter for transmitting an enabling signal to at least one selected installation which allows the blast control equipment at the selected installation to initiate the plurality of detonators.

26 Claims, 1 Drawing Sheet

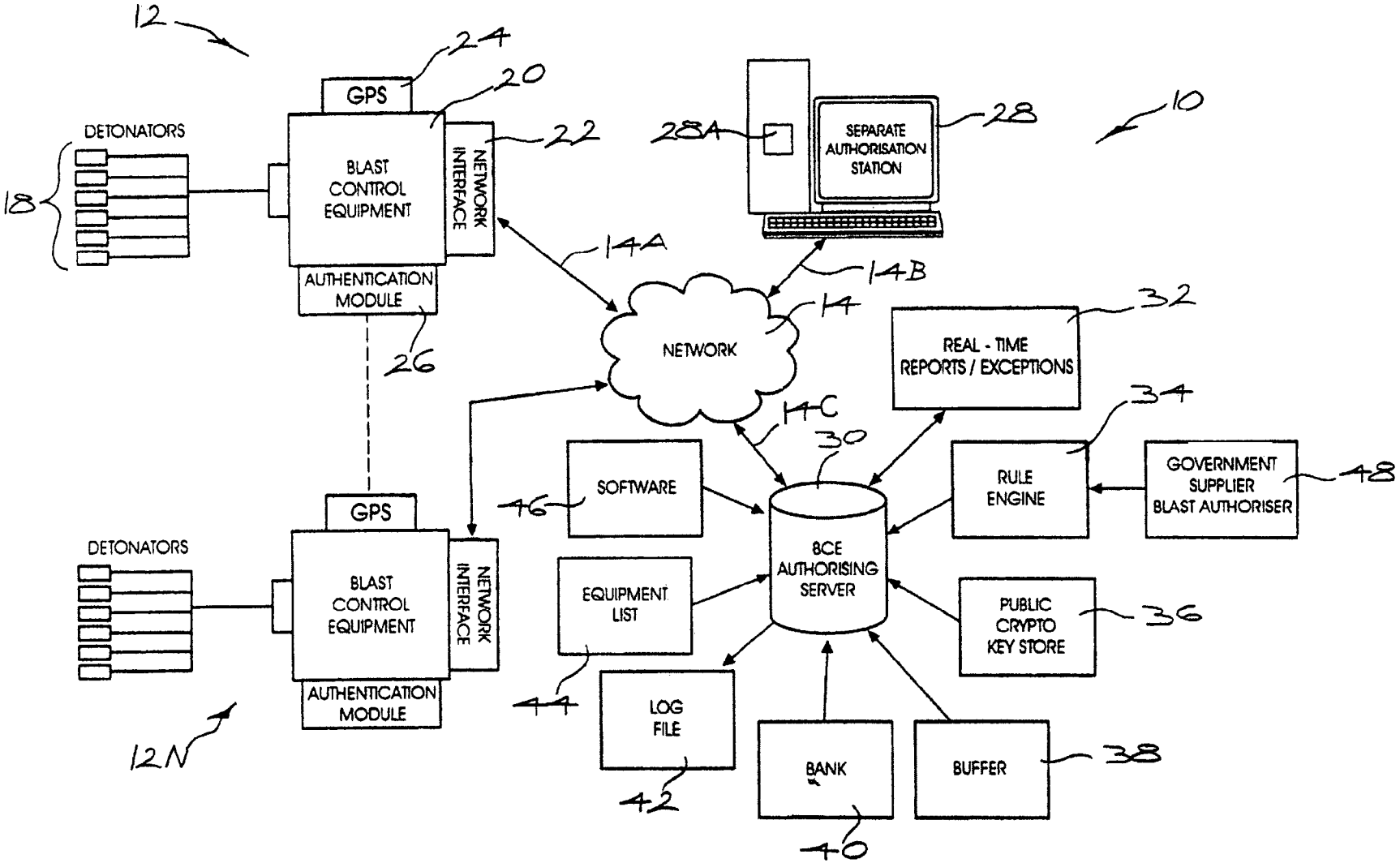
10
12
12N
18
20
22
24
26
28
28A
14
14A
14B
14C
30
32
34
36
38
40
42
44
46
48
GPS
BLAST CONTROL EQUIPMENT
NETWORK INTERFACE
AUTHENTICATION MODULE
DETONATORS
SEPARATE AUTHORISATION STATION
NETWORK
REAL - TIME REPORTS / EXCEPTIONS
RULE ENGINE
GOVERNMENT SUPPLIER BLAST AUTHORISER
PUBLIC CRYPTO KEY STORE
BUFFER
BCE AUTHORISING SERVER
BANK
LOG FILE
EQUIPMENT LIST
SOFTWARE

BLASTING SYSTEM AND METHOD OF CONTROLLING A BLASTING OPERATION

CROSS REFERENCE TO RELATED APPLICATION

This application claims the priority of South Africa Patent Application No. 2004/5795, file on Jul. 21, 2004.

BACKGROUND OF THE INVENTION

This invention relates generally to the control of a blasting operation.

A modern blasting system of the kind which is used for blasting operations in mines, quarries and the like typically makes use of electronic detonators, the number of which can vary and which are configured in a desired pattern, and a blast controller which can be used to program the detonators, if appropriate, and then arm and fire or initiate the detonators when necessary.

The blast controller is usually a complex device which is designed to exercise precise control over the blasting functions of the detonators and to eliminate or at least substantially reduce the likelihood of inadvertent firing of the detonators. It is known to make use of a blasting or activation key to enable the blast controller. This type of key can be physical in nature and generally is stored together with the blast controller at a blasting site. Clearly this represents a security risk in that if a person can gain access to the key the blast controller can be enabled without legitimate authorisation. A blasting system can thus be configured for unauthorised use, a possibility which holds significant adverse security implications.

U.S. Pat. No. 5,520,114 describes a technique in which a magnetic card is used to authorise a blast. U.S. Pat. No. 4,674,047 discloses a technique in which detonators are associated with a two-part security code, a first part being unique to a user and a second part being a firing control code. International patent application No. WO2004020934 describes a system of physical blasting keys to exercise control over the use of blast equipment. It is evident that these approaches concentrate primarily on local security control measures and fail to account for the fact that all the essential requirements for initiating a blast, namely the detonators, control equipment and access means such as keys or cards, are usually stored on the blasting site or in close proximity to each other and thus represent a security risk in the sense of unauthorised access and use.

SUMMARY OF THE INVENTION

The present invention provides a method of controlling a blasting operation, and a blasting system, wherein blast control equipment is used to initiate a plurality of detonators at a blast site, the method including the steps of inhibiting full use of the blast control equipment, conducting a validation process on information and, if the information is validated, enabling at least partial use of the blast control equipment.

The validation process may be conducted on information which is extracted from a request signal. This signal may be transmitted to a control facility.

The request signal may come from any appropriate location e.g. the blast site. Similarly the blast control equipment may be enabled by an enabling signal which may be detected or received at any suitable control point or location e.g. the blast site.

In a principal application of the invention the blast control equipment is enabled to initiate the plurality of detonators.

The blast control equipment may be wholly or partly inhibited or disabled in any appropriate way using hardware or software or a combination thereof. The invention is not limited in this respect. Preferably use is made, at least, of software procedures which depend on encryption/decryption techniques, algorithms, or decoding keys or the like to disable the blast control equipment and, when appropriate, to enable the blast control equipment. For example use may be made of a command filter which may be embedded in suitable software. Another possibility is to use information e.g. a code or algorithm which is required for blasting and which is unknown to the blast control equipment and to include the information in an enabling signal, in a suitable format or medium, e.g. on a smart card to the blast control equipment which, upon receipt of the enabling signal, is then in a state in which a blast signal can be sent.

The extent to which the blast control equipment is disabled may vary according to requirement. Thus it falls within the scope of the invention to disable the blast control equipment wholly or partially. For example one or more procedures which can be carried out by the blast control equipment can be inhibited. The blast control equipment, although disabled, may be permitted to carry out limited or defined operations such as the testing of detonators, the programming of detonators, the arming of detonators or the like, but while inhibited, the blast control equipment is not capable of firing or initiating the detonators.

The disclosed method may be embodied in the form of computer-implemented processes and apparatuses for practicing those processes. The method can also be embodied in the form of computer program code containing instructions embodied in tangible media such as floppy diskettes, CD-ROMs, hard drives, or any other computer-readable storage medium wherein, when the computer program code is loaded into and executed by a computer, the computer becomes an apparatus capable of executing the method.

The present method can also be embodied in the form of computer program code, for example, whether stored in a storage medium, loaded into and/or executed by a computer, or as data signals, whether transmitted as a modulated carrier wave or not, over some transmission medium, such as over electrical wiring or cabling, through fiber optics, or via electromagnetic radiation wherein, when the computer program code is loaded into and executed by a computer, the computer becomes an apparatus capable of executing the method. When implemented on a general-purpose microprocessor, the computer program performs logic operations which are generally equivalent to the physical or mechanical sequences of the kind described herein.

The request signal may be transmitted to the control facility using any appropriate technique and may for example be transmitted wirelessly, through the use of fixed connections such as cables, conductors or the like, by making use of networks such as the internet, by physically transporting the blast control equipment or a component thereof or other apparatus to the control facility or by any combination of the aforegoing. The scope of the invention is not limited in this regard. An important aspect though is that the information which is transmitted should relate to a critical aspect of control of the use of the blast control equipment.

In one form of the invention the request signal is originated by a potential user e.g. a person who is setting up, or who intends to initiate, a blasting operation. It does, however, fall within the scope of the invention for this initiative to be exercised by or via the control facility e.g. an enabling or interrogating signal which is produced in accordance with defined criterion can be transmitted from the control facility to allow blasting to take place at a predetermined site and in accordance with suitable control parameters. Generally with the latter form of the invention the information which is transmitted will be validated by conducting suitable verification processes at the blast site and, if the information is validated, the blast control equipment will be enabled e.g. for a specified time window, for use by a specified person, or subject to certain conditions or parameters, so that blasting can take place.

The validation process may be conducted on any suitable information, e.g. information which is selected from the following:

the identity of a user of the blast control equipment,
the identity of each user, if more than one user is required to make use of the blast control equipment,
the location of the blast control equipment,
the number of detonators which are to be initiated,
the type of detonators which are to be initiated,
the identity of the blast control equipment,
the identity (version) of software or firmware embodied or employed in the blast control equipment,
details of the configuration of the detonators,
information relating to programming of the detonators,
a time or date, typically a window, during which blasting will be allowed,
a unique identifier, and
details of the request e.g. authority is sought for a blast to take place.

The information which is contained in the request signal is not limited and may be varied according to the degree of control which is to be exercised. Further, as is described hereinafter, the information may be chosen to enable a full record to be kept of proposed and actual blasting operations, typically at the control facility.

Also, financial factors may come into consideration. For example a request, or authorization signal, once accepted or positively processed, can give rise to a debit, related to usage or any other factor, against an account of the user. The corresponding payment can be made under prescribed terms. Alternatively payment can be made in advance e.g. via a smartcard or the like and the charge raised for using the system can be deducted automatically from the relevant account.

It also falls within the scope of the invention for any of the aforementioned information to be combined with a further request i.e. a request which does not relate to authorisation for a blast but to a different aspect. For example, under certain conditions, the blast control equipment may be enabled so that it can receive available firmware or software upgrades, information on the status of all or part of the blast control equipment, information relating to a permitted user of the blast control equipment, diagnostic information, or the like. An important aspect in this regard is that the method of the invention lends itself to exercising control over the use of the blast control equipment, in a broad sense, in a manner which is dependent on the selection of one or more parameters chosen to control such use.

The information in the request signal or message can be included automatically e.g. by accessing a memory of any appropriate type in which typical data is stored. Alternatively or additionally the information may be input by a user e.g. by making use of a keypad, a suitable sensor such as a biometric device, responsive to fingerprint data, an iris image or the like, a smart card, a user name or password or a combination of any of the aforegoing.

Information relating to variables such as time and position may automatically be derived from devices such as clocks, positioning systems or the like and processed into a suitable form for inclusion in the request message.

The request signal or message may be transmitted by a transmitter which preferably is integrally linked to the blast control equipment i.e. it is physically or electrically attached to, or forms an integral part of, the blast control equipment. Appropriate steps should be taken in this respect to ensure that a request message is uniquely associated with defined blast control equipment.

In a variation of the invention data relating to a request signal is input or generated and transferred to a portable device which is physically taken to a secondary or intermediate site at which the data is optionally subjected to an interim validation process and then transmitted to the control facility.

The request message may take on any suitable form or structure and preferably is encoded in an appropriate format. For example the message may be composed in XML thus permitting the easy extension of the message to include additional data fields, or the message may be in a binary message format. A requirement in this respect is that the format of the message must be capable of being interpreted at the control facility.

The message may be digitally signed before transmission. A key used for signing the message may be securely embedded in the blast control equipment.

Any appropriate technique for encrypting and digitally signing the message may be adopted. For example RSA public/private key pair cryptographic techniques may be used. Security measures which are known in the art should be adopted for ensuring the integrity of all data relating to such keys and the encryption of the message.

The validation process may be carried out in any appropriate and effective manner.

The nature of the validation process depends inter alia on the type of information included in the request message, on the degree of control which is to be exercised over the use of the blast control equipment and on the type of information, relating to the use of the blast control equipment, which is to be logged. In respect of the last-mentioned point it is to be noted that the method may include the steps of monitoring one or more functions, attributes or operations of the blast control equipment and of storing data relating thereto at the control facility.

For example information may be logged relating to the extent of usage of the blast control equipment such as the number of detonators which are fired, the types of detonators, the times of usage of the blast control equipment, the identity of each user of the blast control equipment, the area or areas in which the blast control equipment is employed, the software included in the blast control equipment and so on. The invention is not limited in this regard. This information is included in the request signal and the manner in which the information is presented may form part of the validation process at the control facility.

It further falls within the scope of the invention for the control facility, which optionally may be remote from the blast control equipment, to carry out or initiate, upon request or independently of a request from the blast control equipment, diagnostic and maintenance routines on the blast control equipment. The use of the blast control equipment may for example be disabled if it is detected that the blast control equipment is faulty, incorrectly calibrated, not calibrated, if a power supply associated with the blast control equipment is faulty, or the like.

It is evident from the aforegoing that, in a broad context, the method of the invention makes it possible to exercise control over the use of the blast control equipment, to derive data relating to the use thereof and to raise a charge for such use.

The enabling signal which is transmitted to the blast site may allow the blast control equipment to initiate the plurality of detonators on a restricted or unrestricted basis. For example the blast control equipment may be allowed to initiate detonators:

(a) of a specific number or type, (b) during a specific time period;

(c) for a specific mine or area;

(d) for a number of blasting processes;

(e) for a specific blast only;

(f) for a defined region; or (g) only under the control or supervision of one or more persons duly authorized e.g. because of training, or for a region, mine, time period or detonator type, etc.

The invention also extends to a blasting system which includes blast control equipment, a plurality of detonators which are configured to be initiated by the blast control equipment, a control facility, a transmitter for transmitting a request signal from the blast control equipment to the control facility, a processor for validating information extracted from the request signal, and a signal generator for generating an enabling signal which allows the blast control equipment to initiate the plurality of detonators if the information is validated.

As used herein the words "transmit" and "transmitter" are to be interpreted in a broad sense as relating to the transfer of information in any appropriate manner e.g. by wireless means, through the use of conductors or connections, by physically conveying the information in any appropriate medium from a source to a destination, or the like.

The blasting system may be adapted to implement all or part of the aforementioned method of controlling a blasting operation.

BRIEF DESCRIPTION OF THE DRAWING

The invention is further described by way of example with reference to the accompanying drawing which is a block diagram representation of a blasting system the operation of which is controlled in accordance with the principles of the invention.

DETAILED DESCRIPTION OF THE INVENTION

The accompanying drawing illustrates a control facility 10, a blast configuration 12 and a communication network 14 which connects the blast configuration 12 to the facility 10, when necessary.

The blast configuration 12 is one of a plurality of blast configurations 12, 12.1, . . . 12N each of which is assembled on a respective site as necessary and according to requirement. The blast configuration may vary according to local circumstances including the choice of detonators, the choice of blast control equipment and the like and, at least for this reason, the configuration 12 is schematically illustrated in a generic sense.

The blast configuration 12 typically includes a plurality of detonators 18, of any appropriate type, and blast control equipment 20 which is usable in a manner which is known in the art to test and program the detonators, if applicable, and then to arm and fire the detonators. In general it can be said that these aspects are accomplished using techniques which are known in the art and which, for this reason, are not further described herein.

The blast configuration includes a network interface 22 which links the configuration to the network 14 for communication purposes, a global positioning system 24 and an authentication module 26.

Use of the network 14 or the control facility 10 can be regulated, if required, by means of an authorisation station 28 including as a tangible medium a CD-Rom 28A, or an equivalent device.

The control facility 10 is based on the use of a control computer or server 30 and may run automatically or on an interactive basis with one or more supervisors.

The facility 10 includes memory in which is stored data or specific programs relating at least to the following functions each of which is represented by a particular block in the drawing: an output device 32 which can generate real time reports or exceptions e.g. a printer or display mechanism; a set 34 of rules, typically embodied in software or a data base, which relate to defined procedures and mechanisms which govern the implementation of a blast system; secure storage 36 for the storage of encryption keys used in an encryption/decryption process; a buffer 38 which provides a temporary store for data going to or coming from the server 30; a financial module 40 which raises charges on a defined accounting basis relating to use of the system; a history file 42 in which is logged statistical data relating to the use of the system and the users thereof; and a schedule 44 which contains data relating to blast control equipment, users' identification data, data on detonators and the like. The scope of the information stored in the schedule is varied according to requirement.

Optionally the facility 10 includes a software update/maintenance module 46 which contains essential computer software used for controlling the operation of blast control equipment.

The network interface 22 may vary according to requirement and generally its form is dictated by the nature of the network 14, or vice versa. For example the interface may provide a communication link into the server using a general short message service (GSM) of the type used in a cellular telephone network, radio techniques may be employed, satellite links may be established or data may be exchanged with the server through the medium of hardwire links which depend on modems or other digital devices. These aspects are generally within the scope of a person skilled in the art of communications and thus are not further described herein.

The authentication module 26 may also vary according to requirement. Primarily its function is to ensure that the blast control equipment is accessed or used only by an authorised person. A user's identity may be authenticated by biometric means e.g. by reading a fingerprint or an iris, through the use of a smart card, by entering a password, through the use of a mechanical key or the like. Again the scope of the invention is not limited in this regard and any appropriate authentication technique or equipment can be employed.

An objective of the invention is to ensure that blasting takes place only under controlled and authorised conditions. These conditions are established by an appropriate authority such as a controlling body, an equipment supplier or a regulatory or governmental institution, represented by a block 48, and are embodied in rules and regulations set out and recorded in the rule module 34. The blast control equipment 20 is designed so that it can only be used when it is enabled by an authorising signal from the server 30.

Assume that the detonators 18 have been installed in blast holes and that the detonators have been programmed and tested. In accordance with the principles of the invention before the detonators are fired the blast control equipment 20 must be enabled. The enablement may take place at any appropriate point in the sequence of operations which normally are carried out through the use of the blast control equipment but, in this example, it is assumed that the enabling signal is required immediately before or after arming of the detonators 18.

A user authenticates himself to the blast control equipment via the module 26 which then generates a blast authorisation request message which is transmitted via the interface 22 and the network 14 by data signals 14A to the server 30. The request message may include at least any of the following information:

the identity or other personal data of the user;

the status of the user—e.g. that the user is qualified or trained to use the blast control equipment;

the location of the blast control equipment—this could be obtained automatically through the global positioning system 24;

the number of detonators 18 which are connected to the equipment;

the identity of the blast control equipment—this is typically a manufacturer's serial number or type number;

the versions of software or firmware employed in the blast control equipment;

details of the blast configuration e.g. the type of detonators, the time delays in the detonators etc.;

a time stamp of the request—typically blasting will only be allowed in a given window i.e. on a given day for a particular period;

details of the request. In the example under discussion the request will be for permission to blast. It is feasible however that other requests, which are subject to similar or varied constraints or requirements can be made by a user such as for information regarding the registration status of the blast control equipment, the software which is available from the module 46 or the like;

a unique cryptographically secure request identifier; and other pertinent information which may be required for authorisation e.g. policy may dictate that a request must be made by two people instead of one person in which event details of the second user's identity would also be included.

The request message is preferably generated substantially automatically by the blast control equipment, under user control. It is possible though for the request message to be composed by a user in response to a succession of prompts which call for answers or inputs in a specific form. The request message is then encoded in any suitable format. The request message may for example be composed in XML thus permitting the easy extension of the message to include additional data fields, or the message may be in a binary message format. A possible requirement in this connection is that the message format should be capable of being interpreted by a blasting authority and the message must be digitally signed before transmission. A key used for signing the message can for example be securely embedded in the blast control equipment or in another storage medium. This key should ideally not be stored in a modifiable storage area in the blast control equipment and a private component of the key must be suitably requested. The request message should also preferably be encrypted by using the public key of the recipient—stored in the module 36 at the control facility.

The recipient's public key will be known to the blast control equipment as the blast control equipment will have been configured to request authorisation from a given recipient by a manufacturer. The public key information should be appropriately protected so that the blast control equipment cannot be "tricked" into accepting an authorisation response from a malicious authoriser.

In a variation of the invention the request message is transmitted by a user who makes use of a suitable communications link (i.e. the network 14) such as a landline or a cellular network. Once the user has "dialled" in to the control facility the user is prompted to enter a code. This can be done using voice recognition or digital input techniques under the control of an interactive program run by the server 30. The code if correctly entered is unique and it can be validated by software at the control facility.

The request message is received at the server 30 and decoded. Information extracted from the message is matched against data held at the server. If the server is overloaded then the message can be queued in the buffer 38. The identity of the blast control equipment 20 can be verified against information drawn from the schedule 44 and decoding takes place using the public key in the storage 36.

Relevant rules from the rule engine 34 are applied to the pertinent data, extracted from the message request, and software in the server determines automatically whether the blast request will be authorised or not. Full details of the blast request are stored in the history file 42 which at any time can be accessed to provide a full log of all relevant activity, in respect of a user or given blast control equipment or any other parameter. Account information, e.g. billing for usage of the system, is automatically generated via the module 40. Financial control can be implemented in accordance with any suitable criteria e.g. chosen to make the control system at least self-funding. A user could for example be required to pay a registration fee, an annual licence fee and a usage fee which is based on the number of blasts and the number of detonators per blast. Payment could be made after usage, or be deducted from a deposit account, or be on a "pay-as-you-go" basis.

If the blast is to be allowed then an authorising or enabling signal 14C is generated and sent by the server 30 via the network 14 to the blast control equipment. The user is alerted that the equipment has been authorised and the blast process can then be continued.

The blast control equipment is normally inhibited in one or more essential aspects until such time as the authorising signal 14C has been sent from the server 30. The inhibition and enablement can be effected via software procedures which, essentially, are controlled from the facility 10. These procedures coupled with the security aspects which have been referred to such as the use of encryption techniques and authentication requirements, make it difficult for an unauthorised person to use the blast control equipment in an unspecified or in a non-allowed manner.

The preceding request/authorization sequence is automatically carried out at the server end in accordance with the rules in the rule engine 34. However if the rules require direct, manual authorization in place of, or in addition to, the automatic authorization from the server then the signal 14A is sent to the station 28 and once a validation process has been positively carried out a separate or additional authorization signal 14B, as the case may be, is sent by the station 28 to the blast control equipment.

In a preferred form of the invention the response signal comprises or contains critical information such as all or part of a blast command which is not otherwise known to the blast control equipment but which is required for a blasting signal to be generated or sent to the detonators 18. Such information may comprise a code or information on a sequence of events which must be complied with if blasting is to take place. This adds an additional level of safety to the use of the system.

As indicated it is possible through the use of the system to control aspects of the blast control equipment other than the enablement thereof. For example updated software can be drawn from the module 46 and transferred to the blast control equipment. The calibration of the blast control equipment can be remotely checked, from the server 30, and it can be recalibrated, sometimes remotely, when necessary. The server 30 can also check on maintenance schedules of the blast control equipment and can inhibit the use thereof until such time as maintenance schedules have been completed. Within reason this ensures that the blast control equipment can only be used when it is functioning according to specification.

In a further variation of the invention the control facility 10 is used, according to predetermined criteria, to enable one or more of the blast configurations without a prior blast authorisation request message having been generated at each respective blast configuration concerned.

For example the control facility 10 could, according to predetermined rules, enable a first group of selected blast configurations on a first working day, between designated hours, a second group of selected blast configurations on a second working day, between designated hours, and so on.

The use of each enabled blast configuration is however still subject to all the usual safety and operating procedures implicit in this type of equipment but the capability to allow each blast configuration to be used only in a designated time window adds considerably to the safety and security of deployment thereof.

The enablement of a blast configuration is only effected after the configuration is uniquely identified, e.g. by means of suitable interrogating signals and, optionally, if the applicable safety and security criteria have been assessed and validated.

Also, information transmitted to a blast configuration can be validated at the blast configuration, optionally correlated with stored data at the configuration and only if the information is verified, is the configuration enabled.

The network 14 has been represented in a symbolic sense only. In general terms the network is essentially any mechanism whereby information can be sent from the blast control equipment to the server, and in the reverse direction. Although wireless or hard wire links can be employed for this purpose it is possible to make use of other, equivalent, techniques. For example the blast control equipment may be directly authorised by taking the blast control equipment to a control facility which then "enables" the blast control equipment to carry out only a blast process of specified parameters. Another possibility is that the facility can enable a module, with defined parameters, which is engaged with the equipment and which then allows the equipment to be used strictly in accordance with the parameters in the module. A smart card or other data storage device can be used for physically transporting data from the blast control equipment to the control facility and, if the information is validated, an enabling signal can then be written to the storage device which is physically transported back to the blast control equipment to enable the equipment to be used under strictly defined conditions.

While the present invention has been described with reference to an exemplary embodiment, it will be understood by those skilled in the art that the invention is not limited to the particular embodiment disclosed, and various changes may be made and equivalents may be substituted for elements thereof without departing from the scope of the invention.

The invention claimed is:

1. A method of controlling a blasting operation wherein blast control equipment is used to initiate a plurality of detonators at a blast site, the method including the steps of: providing input information that comprises at least a) the identity of a user of the blast control equipment;

b) the location of the blast control equipment;

c) the identity of the blast control equipment; and d) a time or date during which blasting will be allowed;

providing inhibition software which is responsive to at least said input information and is connected to the blast control equipment;

using the inhibition software to inhibit full use of the blast control equipment;

providing validation software for conducting a validation process on the input information;

supplying the input information to the inhibit software and to the validation software;

using the validation software to conduct a validation process on the input information, and, if the input information is validated, causing the inhibit software to enable at least partial use of the blast control equipment.

2. A method according to claim 1 wherein the input information further includes and the validation process is conducted on information selected from at least one the following:

the number of detonators which are to be initiated, the type of detonators which are to be initiated, the identity of software or firmware embodied or employed in the blast control equipment, details of the configuration of the detonators, information relating to programming of the detonators, and a unique identifier.

3. A method according to claim 1 including transmitting the input information to the control equipment at the blast site, whereby the validation process is conducted on information transmitted to the blast site.

4. A method according to claim 1 wherein the step of supplying includes generating a request signal including the input information and supplying the request signal to the validation software so that the validation process is conducted on information extracted from the request signal.

5. A method according to claim 4 further including providing a control facility, and transmitting the request signal to the control facility.

6. A method according to claim 5 further including conducting the validation process at the control facility.

7. A method according to claim 5 including transmitting the request signal from the blast site to the control facility.

8. A method according to claim 5 including originating the request signal by a person who is setting up, or who intends to initiate, a blasting operation.

9. A method according to claim 5 including transmitting the request signal using a technique selected from the following: wirelessly, through the use of fixed connections by making use of a network, by physically transporting the blast control equipment or a component thereof to the control facility, by generating the request signal at an intermediate facility from which the request signal is transmitted.

10. A method according to claim 1 wherein the inhibiting software utilizes at least one of the following: an encryption/decryption technique, an algorithm, and a decoding key.

11. A method according to claim 10 wherein the inhibit software inhibits the blast control equipment by withholding information, required for blasting, from the blast control equipment, and said step of causing includes enabling the blast control equipment by transmitting this information to the blast control equipment after the validation process.

12. A method according to claim 1 including permitting the blast control equipment, while full use is inhibited, to carry out operations selected from: the testing of detonators, the programming of detonators, and the arming of detonators.

13. A method according to claim 1 wherein said step of causing includes enabling the blast control equipment to initiate the plurality of detonators.

14. A method according to claim 1 wherein said step of causing includes enabling the blast control equipment so that it can receive at least one of the following: an available firmware or software upgrade, information on the status of all or part of the blast control equipment, information relating to a permitted user of the blast control equipment, and diagnostic information.

15. A method according to claim 1 wherein said step of providing input information includes generating the input information is generated by at least one of the following:

by accessing a memory in which data is stored;

by a user inputting information;

by a biometric device; and by in pulling data from a portable device.

16. A method according to claim 5 wherein said step of transmitting a request signal includes transmitting the request signal by a transmitter which is linked to the blast control equipment.

17. A method according to claim 5 which includes the step of logging information relating to at least one of the following:

the extent of usage of the blast control equipment;

the number of detonators which are fired;

the types of detonators;

the times of usage of the blast control equipment;

the identity of each user of the blast control equipment;

the area or areas in which the blast control equipment is employed; and the software included in the blast control equipment.

18. A method according to claim 17 further comprising including the logged information in the request signal.

19. A method according to claim 1 which includes the steps of providing a control facility which is remote from the blast control equipment, and initiating diagnostic or maintenance routines on the blast control equipment at the control facility.

20. A method according to claim 1 wherein the step of causing includes allowing the blast control equipment, when enabled, to initiate detonators:

of a specific number or type;

during a specific time period;

for a specific mine or area;

for a number of blasting processes;

for a specific blast;

for a defined region; or under the control or supervision of one or more authorized persons.

21. A method according to claim 5 further including transmitting the request message via a communications link to a control facility at which the validation process is conducted.

22. A method according to claim 21 wherein the communications link is a cellular network.

23. A method according to claim 22 further including transmitting the request message using voice recognition or digital input techniques under the control of a program which is run at the control facility.

24. A method according to claim 1 further including providing a control facility and wherein said step of causing includes enabling the blast control equipment by a signal sent from the control facility.

25. A method according to claim 24 further including providing a plurality of separate installations of blast control equipment, and selectively enabling each installation by a respective signal from the control facility.

26. A method according to claim 4 further including providing a control facility, and wherein said step of generating a request signal includes sending the request signal from the control facility to the blast site, and said step of using the validation software includes conducting the validation process at the blast site.

* * * * *